US006108954A

United States Patent [19]

Eiteneer et al.

[11] Patent Number: 6,108,954

[45] Date of Patent: Aug. 29, 2000

[54] MOTION SENSITIVE ANIMATED ADVERTISING DEVICE

[76] Inventors: Nikolai N. Eiteneer, Novokosinskaya Street 21, Apt. #164, Moscow 111672, Russian Federation; Boris N. Eiteneer, 845 Riley Dr., Albany, Calif. 94706

[21] Appl. No.: 08/832,440

[22] Filed: Apr. 3, 1997

[51] Int. Cl.[7] ..... G09F 19/08

[52] U.S. Cl. ..... 40/424; 40/613; 116/215

[58] Field of Search ..... 40/413, 424, 613, 40/455, 486; 116/35, 42, 43, 44, 45, 46, 50, 51, 203, 215

[56] References Cited

U.S. PATENT DOCUMENTS

| | | | |
|---|---|---|---|
| D. 80,123 | 12/1929 | Intingaro | 40/413 X |
| D. 80,124 | 12/1929 | Intingaro | 40/413 X |
| 1,168,751 | 1/1916 | Schuhmann . | |
| 1,264,946 | 5/1918 | Leggett . | |
| 1,382,230 | 6/1921 | Pyper . | |
| 1,567,453 | 12/1925 | Murrah | 40/413 |
| 1,635,937 | 7/1927 | Grillo et al. | 40/413 |
| 1,792,396 | 2/1931 | Robinett | 40/413 |
| 1,794,466 | 3/1931 | Lowenstein . | |
| 2,002,675 | 5/1935 | Outcault | 40/424 |
| 2,066,641 | 1/1937 | Melior et al. | 116/35 R X |
| 2,099,277 | 11/1937 | Peterson | 40/424 |
| 2,109,523 | 3/1938 | Calhoun | 116/215 X |
| 2,389,606 | 11/1945 | Borregard | 40/613 X |
| 2,757,954 | 8/1956 | Hurley | 40/413 X |
| 2,844,898 | 7/1958 | Youngren . | |
| 3,149,606 | 9/1964 | Falkner | 116/203 X |
| 3,418,964 | 12/1968 | Peterson | 116/203 X |
| 3,479,982 | 11/1969 | Honcharenko | 116/35 R |
| 3,936,965 | 2/1976 | Ravn et al. . | |
| 4,028,829 | 6/1977 | Murray | 40/485 |
| 4,060,004 | 11/1977 | Scholz et al. | 116/203 X |
| 4,089,130 | 5/1978 | Byrnes | 40/613 |
| 4,546,562 | 10/1985 | Jones | 40/591 |
| 4,872,278 | 10/1989 | Ross et al. | 40/424 |
| 4,953,315 | 9/1990 | Romaine | 40/424 X |
| 5,178,067 | 1/1993 | Collier | 40/455 X |
| 5,271,173 | 12/1993 | Huang | 40/455 X |
| 5,562,459 | 10/1996 | Durlach | 40/455 X |

FOREIGN PATENT DOCUMENTS

| | | | |
|---|---|---|---|
| 214463 | 4/1924 | United Kingdom | 40/413 |

*Primary Examiner*—Joanne Silbermann
*Attorney, Agent, or Firm*—Chadd T. Kawai

[57] ABSTRACT

A motion sensitive animated advertising device for mounting to a moving vehicle. The present invention comprises at least one moving element having two stable positions wherein the movement of the vehicle causes the element to shift from one stable position to the other stable position.

19 Claims, 15 Drawing Sheets

MOTION SENSITIVE ANIMATED ADVERTISING DEVICE

FIELD OF THE INVENTION

The present invention relates to the field of advertisements. More particularly, the present invention relates to the field of motion sensitive animated advertisement displays for moving vehicles.

DESCRIPTION OF THE PRIOR ART

Advertisers have long been faced with the dilemma of designing advertisements that attract and maintain a consumer's attention in order to successfully convey a particular message. One particularly effect method for attracting the consumer's attention is by incorporating movement into the advertisement. For example, U.S. Pat. No. 2,002,675 to Outcault and U.S. Pat. No. 2,099,277 to Peterson both describe animated advertising signs for use on a moving vehicle. These devices include a stationary panel with a painted figure. A flexible spring arm is mounted at one end to the stationary panel and at an opposite end to an arm or head. Unfortunately, these devices only teach the animation of a single element in a single plane (i e. the arm or head). Furthermore, the animated elements only have one stable position, therefore, the designer has less control over the advertisement's visual impact. These factors limit the visual impact of the advertisements, thereby limiting their effectiveness.

U.S. Pat. No. 1,168,751 to Schuhmann describes another animated advertising device. Schuhmann is specifically designed for use on public vehicles such as railway cars or buses which are usually equipped with parallel advertising rails between which a cardboard billboard can be inserted. The device incorporates a panel depicting a stationary scene. Two moving elements: 1) a woman's arm holding a club and 2) half of the word "rub" are each pivotally mounted to the panel for movement from a first position to a second position. The two elements move in a first plane is parallel to the forward and rearward direction of the vehicle. The two elements are coupled together by cables which lead to a weighted load located in front of the panel wherein the weighted load is responsive to motion of the vehicle in a plane transverse to the forward and rearward motion of the vehicle. In other words, it is movement of the vehicle side-to-side or perhaps up-and-down that moves the weighted load. As the vehicle rocks left to right, the weighted load moves, thereby pulling the cable which animates the two moving elements. Unfortunately, as with the previously described devices, Schuhmann does not provide for more than one stable position. As evidenced from his design, the weighted load merely swings back and forth. The only stable position is when the load is centered in the yoke. Furthermore, it is the rocking motion of the vehicle that causes the elements to move, not the forward and rearward movement of the vehicle.

What is needed is a motion sensitive advertising device that has elements which move in the same direction as the direction of travel of the vehicle. What is further needed is a motion sensitive advertising device that integrates complex animations to produce a coherent advertising display. What is still further needed is a design that allows for at least two stable positions for allowing greater control of the movement of device's movement.

SUMMARY OF THE INVENTION

The present invention provides for a motion sensitive animated advertising device for mounting to a moving vehicle that is subject to acceleration and deceleration forces in a movement plane of the vehicle, comprising: a) a first element coupled to the advertising device for moving from a first stable position to a second stable position relative to the vehicle and in a first plane parallel to the movement plane; and b) a second element coupled to the advertising device for moving from a third stable position to a fourth stable position relative to the vehicle and in a second plane parallel to the movement plane, wherein the first and second elements move in conjunction with one another in response to the acceleration and deceleration of the vehicle and inertia. Ideally the movement plane of the vehicle is parallel to a longitudinal plane of the vehicle although it can also be transverse to a longitudinal plane of the vehicle.

It is further contemplated that the first element has a mass greater than a mass of the second element so that a greater acceleration and deceleration force is necessary to move the first element than is needed to move the second element. Alternatively, second element can have a mass greater than a mass of the first element so that a greater acceleration and deceleration force is necessary to move the second element than is needed to move the first element.

It is still further contemplated that first element is a translating panel and the second element is a rotatable shutter. Alternatively, the first element is a rotating panel and the second element is a rotating bird.

In order to provide for audience participation, the present invention can also include a driver for allowing a viewer to manually control movement of the first and second elements. In order to further attract a viewer's attention, a sound inducing device or a light emitting device can be included for generating a sound in response to acceleration and deceleration of the vehicle.

In yet another embodiment, the present invention provides for a motion sensitive animated advertising device for mounting to a moving vehicle, comprising at least one element having a first and a second stable position, wherein the one or more elements will remain at one of the stable positions until movement of the vehicle causes the element to shift to the second stable position.

DETAILED DESCRIPTION OF THE PREFERRED EMBODIMENTS

Figure 1A:
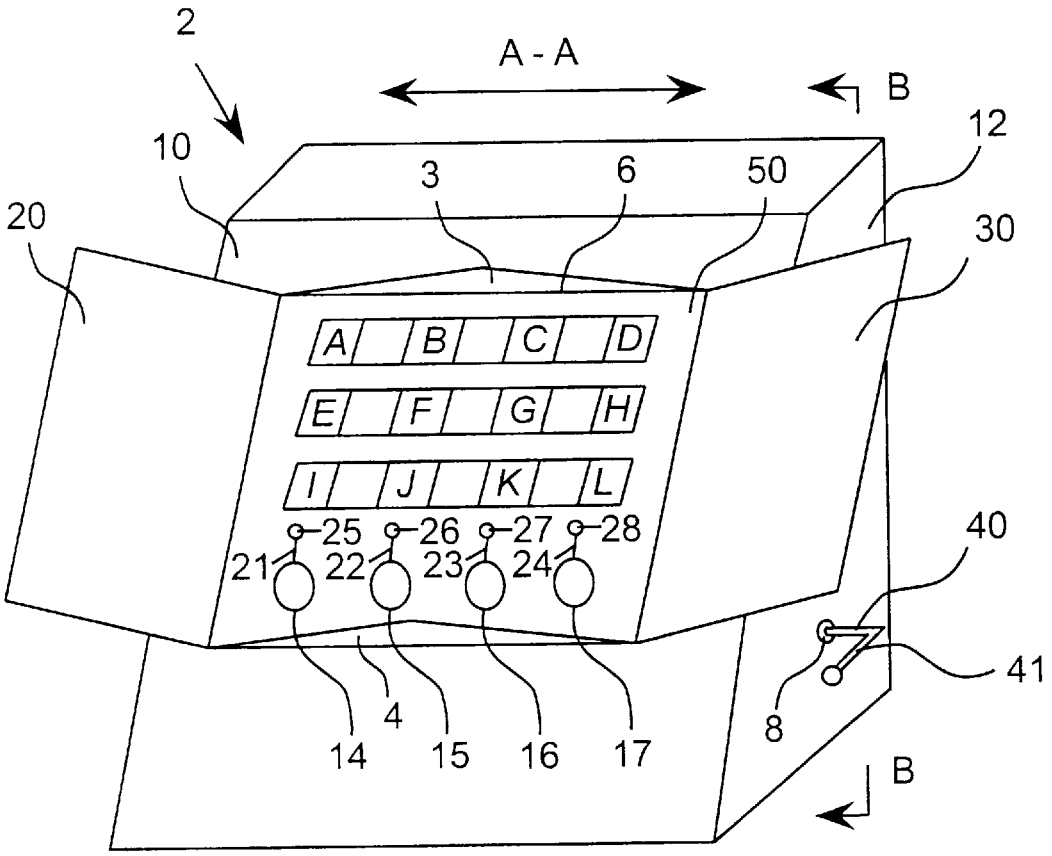
FIG. 1A illustrates a front perspective view of one embodiment of the present invention with the shutters in an open position.
Figure 1B:
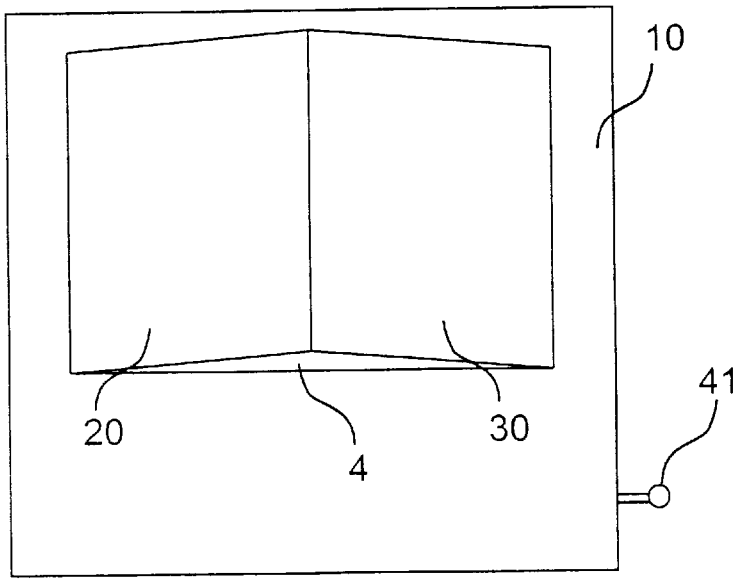
FIG. 1B illustrates a front view of the present invention with the shutters closed.

The present invention provides for a motion sensitive animated advertising display for mounting to a moving vehicle or body having a longitudinal plane and parallel to the vehicle's primary direction of travel (i.e. forward and rearward). The moving vehicle can be, but is not limited to, an automobile, bus, train, subway train, airship, seacraft, elevator, door, window or movable covers. The present invention comprises an advertising display having at least two integrated elements each of which can move between a first predetermined stable position and a second predetermined stable position. A stable position is one in which the element will remain until a force moves the element to the second stable position. For example, a see-saw has two stable predetermined positions, one in which the left end touches the ground and a second wherein the right end touches the ground. The see-saw will remain in one of the stable positions until a force is applied to move the see-saw to the other stable position.

As stated above, the elements of the present invention are further designed to be integrated, i.e., they move in conjunction with one another and in relation to the vehicle. In other words, the different elements move in some predetermined manner with respect to one another in order to produce a coherent advertising design. It is contemplated that the integrated elements be designed into advertising designs which promote, for example, products, companies, schools, services, or messages.

Generally, the present invention includes a plurality of different elements coupled to a base or housing which in turn is coupled to a moving vehicle. The present invention is designed so that acceleration and deceleration of the vehicle and inertia of the elements themselves, causes the elements to move in a predetermined manner in relation to the vehicle and to one another. It is well known that inertia is the tendency of a body at rest to remain at rest or of a body in motion to stay in motion unless acted upon by an outside force. Furthermore, a body having a larger mass has a greater degree of inertia than a body with a smaller mass. Therefore, by manipulating pivot points and centers of masses of the different elements of the present invention, specific predetermined movements can be created. Furthermore, elements with large masses can be designed to move only in response to a large acceleration force while elements with a small mass can be designed to move only in response to a small acceleration force.

The movements contemplated in the present invention include rotational motion, linear or arcuate translations and chaotic motions (i.e. random motions such as a ball on a thread). Additionally, particular elements are not restricted to movement in parallel planes, but can also move in three-dimensional space.

Additionally, animation of the different elements can be related in such a way as to create a "cause and effect" relationship. In this way, the entire display can be configured to produce an integrated image. For example, a second action can be seen only if a first action is completed. In other words, motion of a second element can be seen only when a first element is in one position, and cannot be seen when the first element is in another position (cause).

While the present invention will be described in detail by way of illustration and example, for purposes of clarity of understanding, it will be understood by those skilled in the art that certain changes and modifications may be made to the described embodiments without departing from the spirit of the invention and scope of the appended claims.

Turning now to the figures, FIGS. 1 through 7 illustrate different aspects of one embodiment of the advertising device of the present invention. FIG. 1A illustrates a front perspective view of one embodiment of the advertising device 2 for mounting to a moving vehicle (not shown) so that forward and rearward travel of the vehicle is parallel to line A—A. For example, the device can be mounted to the side of the moving vehicle. Any well known means for securely mounting the advertising device 1 to the vehicle can be used. Alternatively, the advertising device 2 can be mounted to the vehicle so that line A—A is transverse to the forward and rearward travel of the vehicle. In other words, the advertising device 2 can be mounted to the front or back of the vehicle. In this orientation, line A—A is parallel to the side-to-side movement of the vehicle (i e. a rocking motion).

The advertising device 2 comprises a housing 10 made of a non-transparent material including, but not limited to, plastic, wood, steel or cardboard. The front of the housing has two non-transparent shutters 20 and 30 rotatably fixed at their axis' of rotations to the housing 10 as will be described in more detail below. The shutters 20 and 30 can be manufactured of any nontransparent material including but not limited to the same material as the housing 10. A handle 41 extends from an aperture 8 in a side 12 of the housing 10. The purpose and operation of the handle 41 is explained in detail below.

FIG. 1A further reveals a window opening 6. Along the top and bottom rails of the opening are optional triangular wedges 3 and 4 which extend outward from the window openings 6. Shutters 20 and 30 rest against the triangular wedges 2 and 3 when closed (see FIG. 1*b*). The window opening 6 exposes a screen 50 having a plurality of apertures A through L. The size and configuration of the apertures A through L are not critical to the movement of the device, but should complement the moving panel 70 (shown and explained below). The screen 50 can be made of any material including, but not limited to wood, plastic, paper, cardboard, or metal. A plurality of disks 14, 15, 16 and 17 hang freely from lines 21, 22, 23 and 24 and pins 25, 26, 27 and 28, respectively. The disks 14, 15, 16, and 17 can be made from the same material as the screen 50 and are not limited to a particular shape and can be, for example, spherical. As the vehicle moves, the disks 14, 15, 16, and 17 randomly dangle from the lines 21, 22, 23 and 24. It is contemplated that the disks 14–17 is opaque and hide images or letters (not shown) printed behind them on the screen 50. When the disks 14, 15, 16, and 17 are stationary such as when the vehicle is at a stop, the images or letters are hidden. When the disks 14, 15, 16, and 17 moves, however, the images or letters are revealed.

Figure 2:
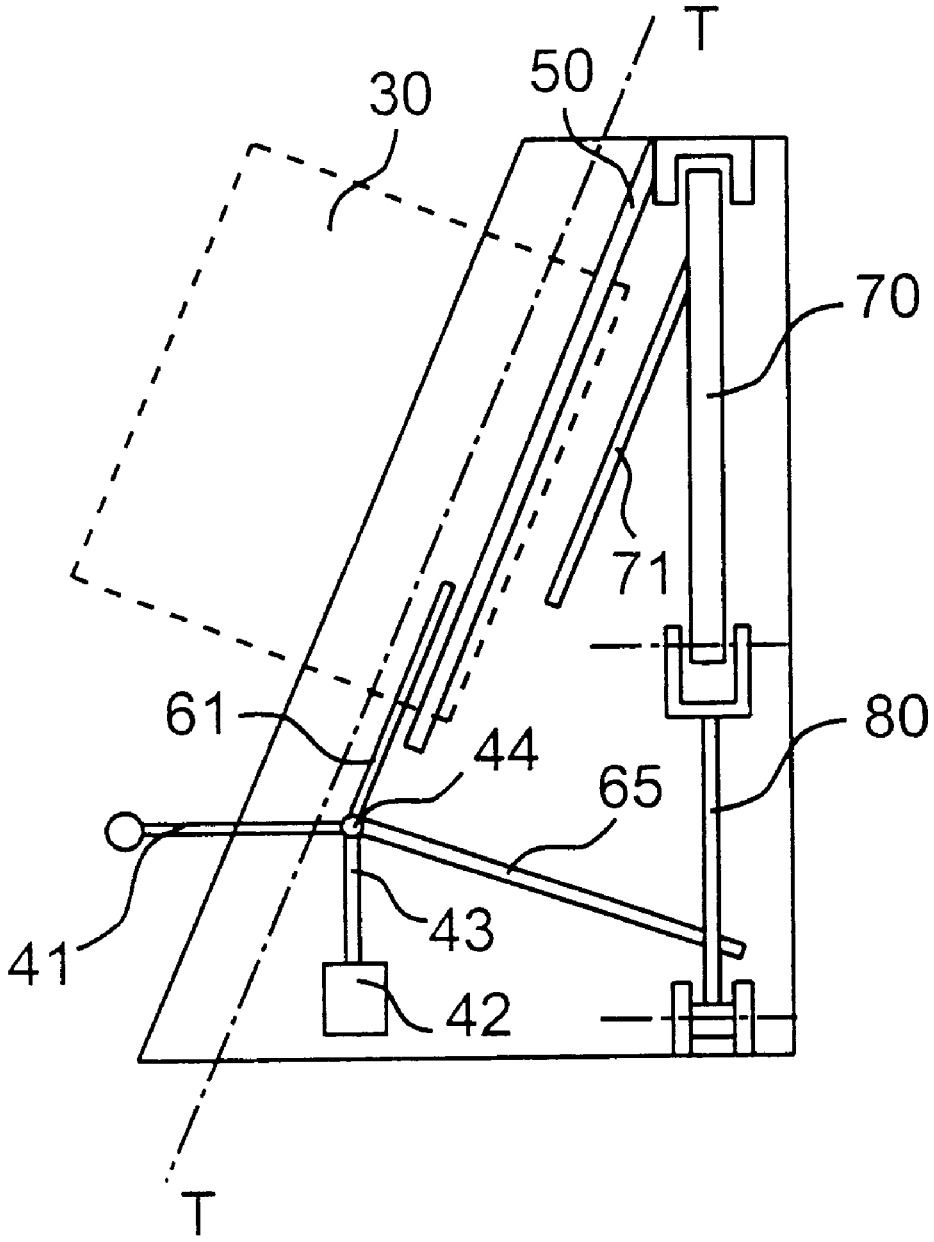
FIG. 2 illustrates a cut out side view of the embodiment illustrated in FIG. 1 along line B—B.

FIG. 2 illustrates a cut out side view of the advertising device 2 along line B—B shown in FIG. 1A. This view illustrates the shutter 30 in dotted lines and the screen 50. Behind the screen 50 is a panel 70 and sheet 71 which are supported by bearings 80 and 81. Handle 41 is coupled to shaft 44 having arms 61, 62, 63 and 64 (although only arm 61 can be seen in this side view) and arms 65 and 66 (although only arm 65 can be seen in this side view). Finally, a biasing load 42 is coupled to the shaft 44 by rod 43. These elements are described in more detail below.

Figure 3:
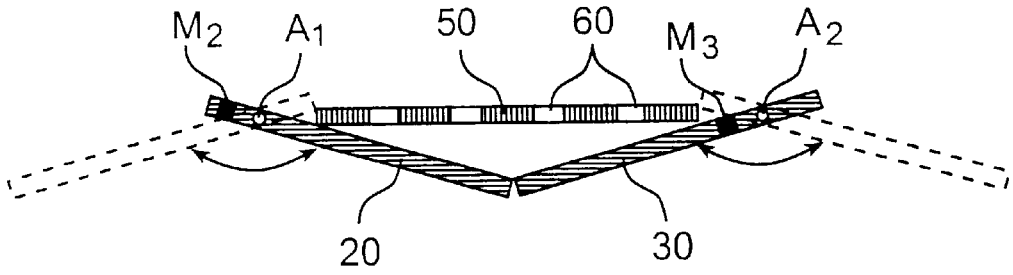
FIG. 3 illustrates a top view of the shutters and the screen and their range of motion.

FIG. 3 illustrates a top view of the shutters 20 and 30 in relation to the screen 50 and their axes' of rotation 1 and 2, respectively. As discussed above, the shutters 20 and 30 are rotatably fixed to the housing 10 at axis' of rotation A1 and A2, respectively. FIG. 3 also illustrates the location of the shutters' center of masses M2 and M3. The shutters 20 and 30 are designed so that the location of their center of masses determine if the shutters will open or close when the vehicle accelerates or decelerates. More specifically, shutter 20 is designed so that its center of mass is to the left of the axis of rotation 1 when the shutter is closed. This can be accomplished by adding additional weight such as lead to the left portion of the shutter 20. This results in acceleration of the vehicle causing shutter 20 to open and deceleration causing shutter 20 to close.

Shutter 30 is designed so that its center of mass is to the left of its axis of rotation 2 when the shutter is closed. Again, this can be accomplished by adding additional weight such as lead to the shutter. Therefore, acceleration of the vehicle causes shutter 30 to open and deceleration of the vehicle causes shutter 30 to close. The coordination of the two shutters 20 and 30 and their respective center's of masses results in shutters 20 and 30 always rotating in opposite directions.

It should be noted that from FIG. 3 it is apparent that shutters 20 and 30 are never parallel with the vehicle's direction of movement. This is because such a configuration would freeze the shutters in either a closed or open position. In other words, the line between the center of masses M2 and axis A1 can never be parallel with the direction of travel of the vehicle. Like wise with center of mass M3 and axis A2. This is because forward movement of the vehicle would then have no effect to open of close the shutters. Wedges or shims can be incorporated to ensure that the shutters are never parallel with the vehicles direction of movement. Any other well known methods for configuring the shutters can also be incorporated to prevent this occurrence.

Figure 4:
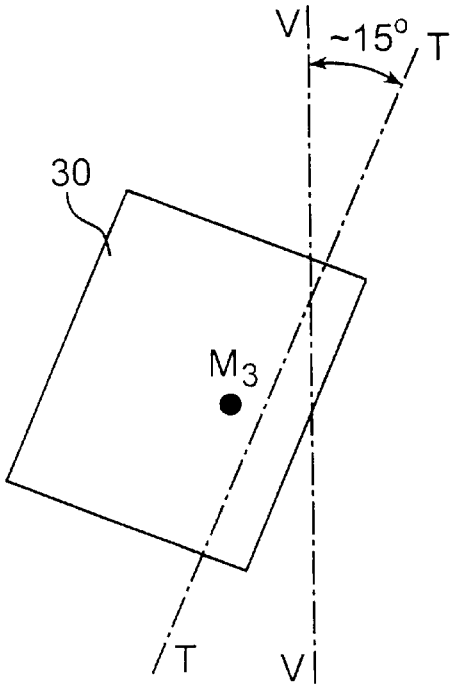
FIG. 4 illustrates a side view the orientation and center of mass of one of the shutters.

It is also recognized that the unsteady movement of the vehicle gives rise to inertial forces which apply a torque to shutters 20 and 30, making them partially open or close, depending on the vehicle's acceleration or deceleration. FIG. 4 illustrates that the rotational axis of shutter 30, T—T, is configured at a small angle (approximately 15°) from a vertical line V—V with respect to gravity. The same is true of shutter 20. This provides for only two positions of stable equilibrium when the vehicle is at rest, namely, both shutters being open or closed. The result is that shutters 20 and 30 will never rest at a partially open or closed state.

Figure 5A:
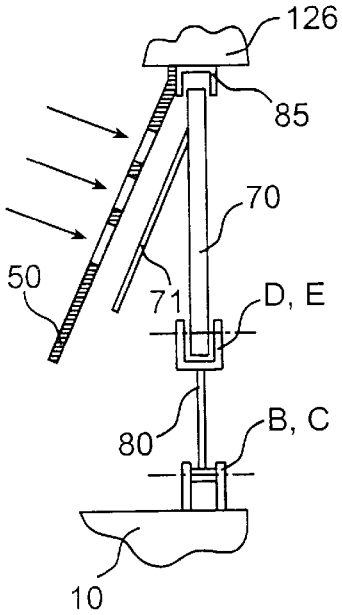
FIG. 5A illustrates a side view of the stationary window screen and moving panel.

FIGS. 5*a*–*d* illustrate the operation and movement of panel 70 and sheet. FIG. 5*a* illustrates a side view of the screen 50 and its apertures A–L. Behind screen 50 is a movable panel 70 supporting sheet 71 which angles away from panel 70 such that the sheet 71 is parallel with the screen 50. Text or images 31 are printed on sheet 71 and are sized and positioned to be seen through the apertures A–L. Panel 70 and screen 71 can be manufactured from any material including, but not limited to, plastic, cardboard, paper, wood or metal. The text/figures 31 are configured in such a way that the text/figures 31 are visible through the apertures A–L only when the sheet 71 is in a particular position. Alternatively, the text/images 31 can be configured so that a portion of the text/image 31 is visible when the sheet 71 is in a first position while another portion of the text/image 31 is visible when the sheet 71 is in a second position. This allows, for example, different text messages to be displayed depending on which position the sheet 71 is located.

Figure 5B:
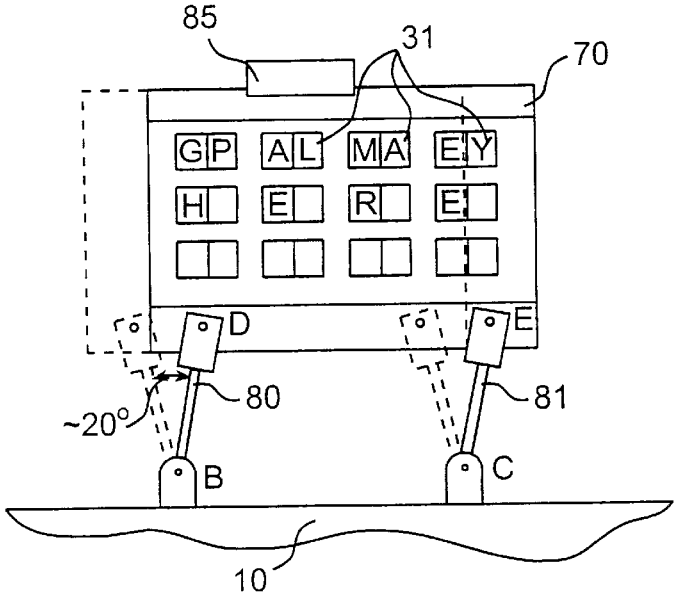
FIG. 5B illustrates a front view of the moving panel and its range of motion.

FIG. 5B illustrates a front view of sheet 71 and panel 70. Panel 70 is supported on two bearings 80 and 81, which rotate about hinge supports B and C fixed to the inside of the housing 10. The two bearings 80 and 81 have a small angle of rotation (approximately 20°). The two bearings 80 and 81 can also rotate for the same angle about points of hinge supports D and E. therefore, panel 70 is capable of producing a curvilinear rocking translating motion with edge DE remaining horizontal at all times. A guide 85 is also coupled to the base 126 to ensure that the panel 70 freely translates in a linear motion from left to right.

Figure 5C:
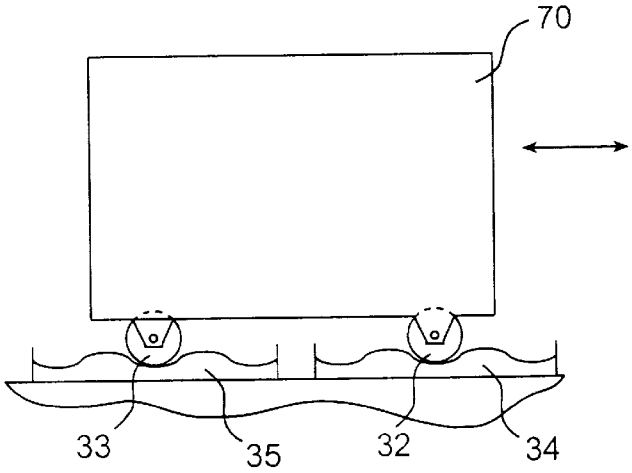
FIG. 5C illustrates an alternative mechanism for animating the moving panel.
Figure 5D:
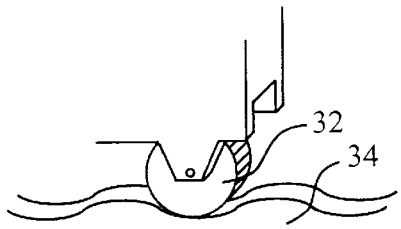
FIG. 5D illustrates the rollers and track on which the panel 70 moves.

Panel 70 can also incorporate additional designs for translating back and forth. For example, FIG. 5C–D illustrate a front view of an alternative design wherein panel 70 is coupled to rollers 32 and 33 which ride on tracks 34 and 35 within the housing 10. As shown in FIG. 5C and D, the tracks 34 and 35 can be wavy in order to provide for any number of stable positions each corresponding to a valley in the tracks.

In operation, panel 70 moves from left to right in the housing 10 due to acceleration and deceleration of the vehicle and the inertia of the panel 70. Due to this design, panel 70 has two positions of stable equilibrium, namely all the way right and all the way left. The apertures 60 and text/images on sheet 71 are related in such a way that when the panel 70 is in the rightmost position, the first part of the text or image is visible through the apertures 60 and the second part is hidden by screen 50. When the panel 70 is in the leftmost position, the second part of the text or images becomes visible through apertures 60, while the first part is hidden. It is also contemplated that screen 50 be made movable and panel 70 stationary with the same operational principles.

In order to provide for synchronized movements, the advertising device 2 of the present invention contemplates that particular elements move only in response to large acceleration forces while other elements move only in response to small acceleration forces. For example, the angles of rotation and masses of the shutters 20 and 30 and panel 70 can be selected so that shutters 20 and 30 open or close only during rough acceleration/deceleration of the vehicle while panel 70 responds additionally to smaller movements of the vehicle. For example, shutters 20 and 30 can be designed so that they will open only during the initial acceleration of the vehicle after a stop and close only during final deceleration of the vehicle before the next stop. Panel 70 can be designed to translate back and forth, however, throughout the vehicle's travel from location to location.

The different elements of the advertising device 2 of the present invention are also designed so that they operate in an integrated manner. Therefore, when the shutters 20 and 30 are open, a viewer sees a changing image (i.e. alternating text messages). To further attract a viewer's attention, the movable disks 14, 15, 16, and 17 randomly move due to the unsteady motion of the vehicle. To still further attract a viewer's attention, several moving panels with different messages or images, as well as other movable and stationary elements, some of which can be interconnected to achieve synchronous movements, can be incorporated.

Figure 6A:
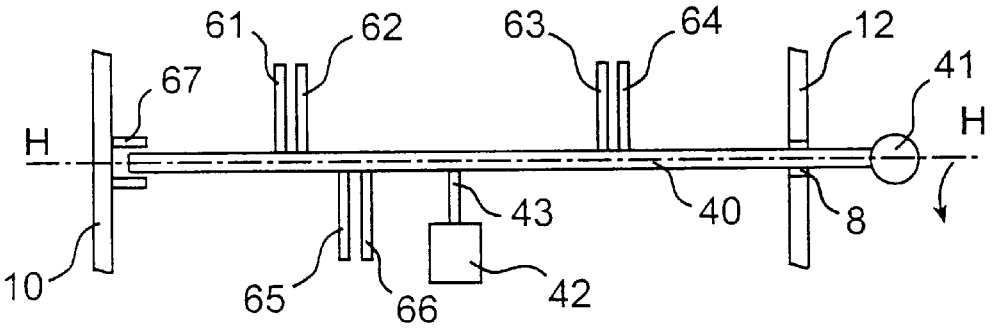
FIG. 6A illustrates a front view of the driver and arms.
Figure 6B:
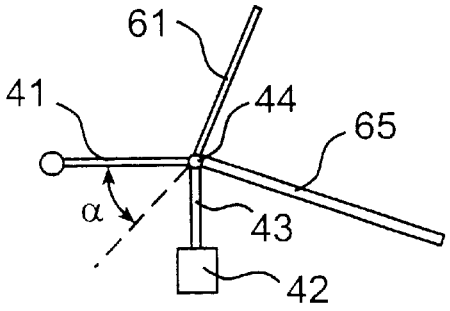
FIG. 6B illustrates a side view of the driver and arms.

The advertising device 2 of the present invention also contemplates participation by viewers in the movement of the different elements. FIG. 6*a* illustrates a driver 40 which rotates about axis H—H and is held in place within the housing 10 by aperture 8 and socket 67. The driver 40 comprises shaft 44 having a handle 41 at one end. Although shown in the figures as configured at a right angle with respect to the shaft 44, handle 41 can have any shape that allows a viewer to rotate the driver 40. Extending from the shaft 44 is a load 42 coupled to a rod 43. Also extending from the shaft 44 are a plurality of arms 61, 62, 63, 64, 65 and 66. FIG. 6*b* illustrates a side view of the driver 40 along the axis H—H. FIG. 6B also illustrates the angle c through which the handle 41 can rotate.

Basically, arms 61 and 62 control movement of shutter 20, arms 63 and 64 control movement of shutter 30 and arms 65 and 66 control movement of panel 70. Load 42 returns the handle 41 to a horizontal position when no external force is applied by an audience member. Alternatively, the load 42 can be replaced with a biasing spring (not shown).

Figure 7A:
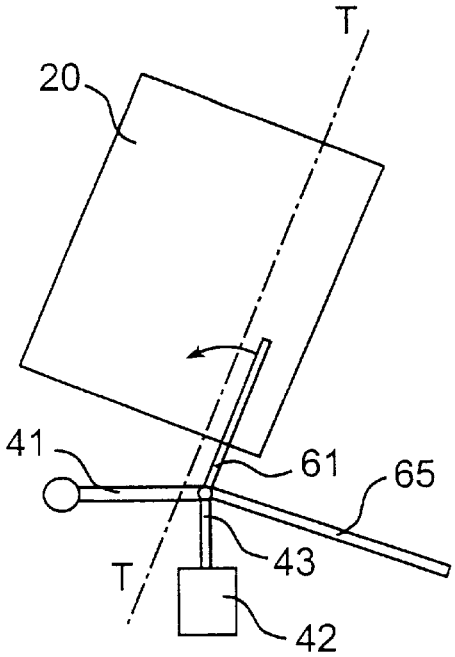
FIG. 7A illustrates a side view of the driver and how it interacts with the shutter 20.
Figure 7B:
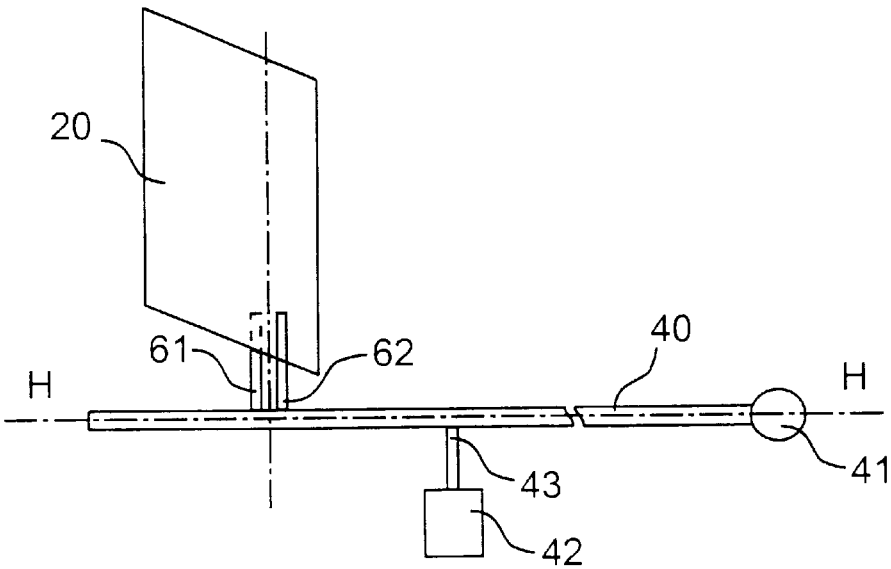
FIG. 7B illustrates a front view of the driver and how it interacts with the shutter 20.
Figure 7C:
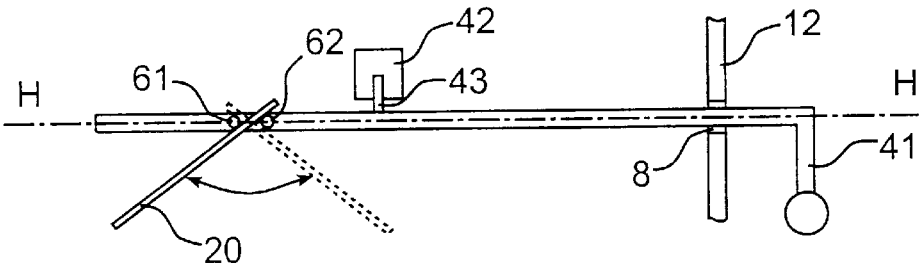
FIG. 7C illustrates a top view of the driver and how it interacts with the shutter 20.
Figure 7D:
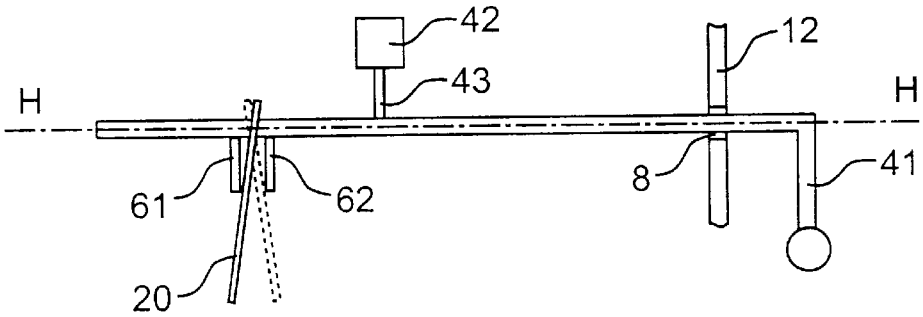
FIG. 7D illustrates another top view of the driver and how it interacts with the shutter 20.

FIG. 7A illustrates a side view of the driver 40 and how arms 61 and 62 are configured to control shutter 20. FIG. 7B illustrates a front view of the driver 40 and arms 61 and 62. As illustrated by these figures, shutter 20 and be sandwiched between arms 61 and 62 by rotating handle 41. When handle 41 is horizontal, arms 61 and 62 are relatively parallel with axis T—T. This allows shutter 20 to rotate through a wide range as shown in FIG. 7C which illustrates a top view of the driver 40 and shutter 20. In other words, arms 61 and 62 do not limit the rotational movement of shutter 20. Likewise, when the handle/driver 40 is rotated so that the handle points straight down and arms 61 and 62 are horizontal, arms 61 and 62 do not impede the rotation of shutter 20. However, when handle 41 is at a midway point between horizontal and pointing straight down, arms 61 and 62 impede the rotational motion of shutter 20 (see FIG. 7D). This limits the rotational angle through which the shutter 20 can rotate. Arms 63 and 64 operate in the same manner with shutter 30.

Figure 7E:
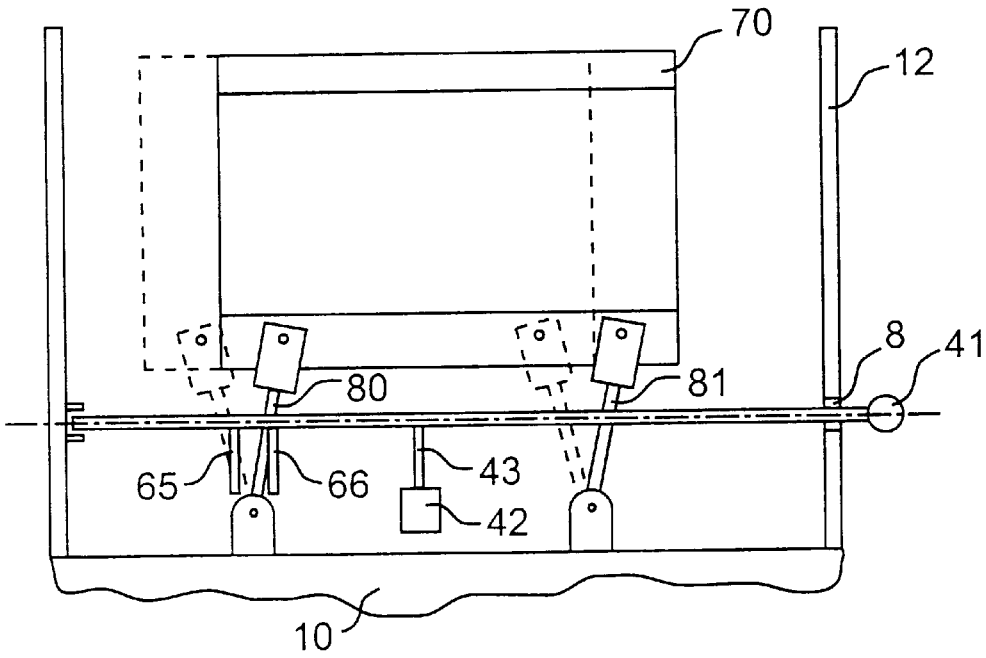
FIG. 7E illustrates a front view of the driver and how it interacts with the panel 70 to allow a greater range of motion.
Figure 7F:
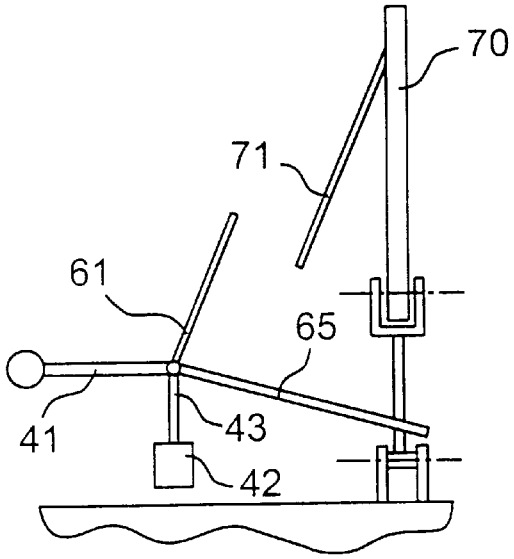
FIG. 7F illustrates a side view of the driver and how it interacts with the panel 70 to allow a greater range of motion.
Figure 7G:
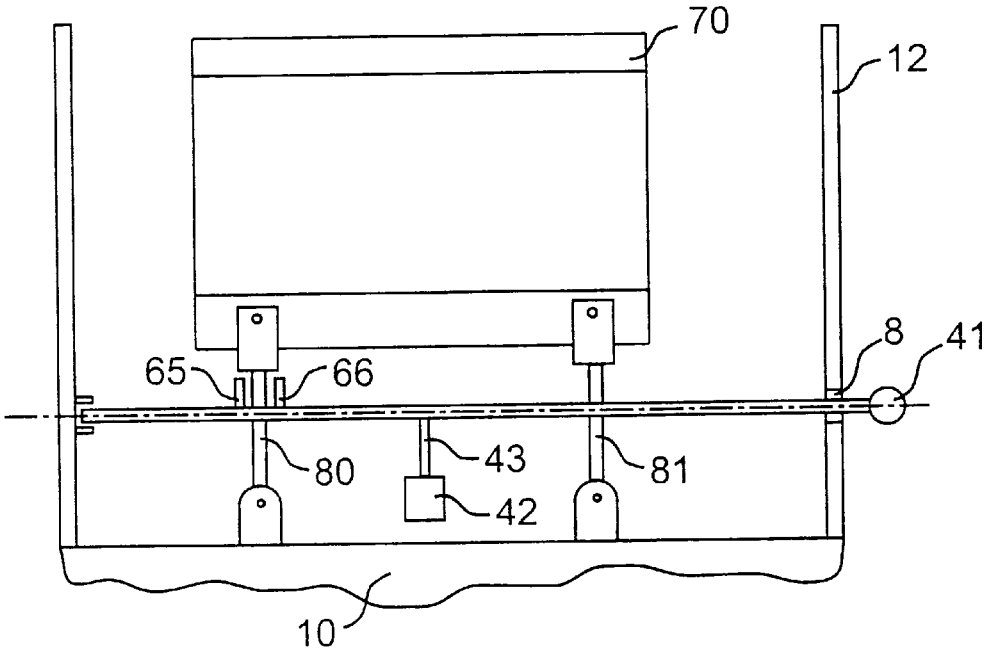
FIG. 7G illustrates a front view of the driver and how it interacts with the panel 70 to allow a restricted range of motion.
Figure 7H:
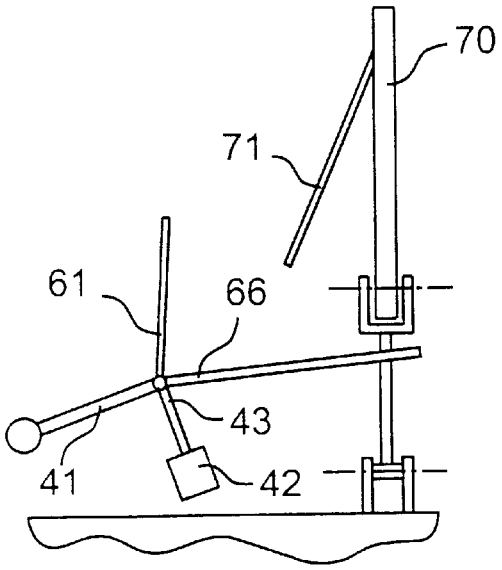
FIG. 7H illustrates a side view of the driver and how it interacts with the panel 70 to allow a greater range of motion.
Figure 8A:
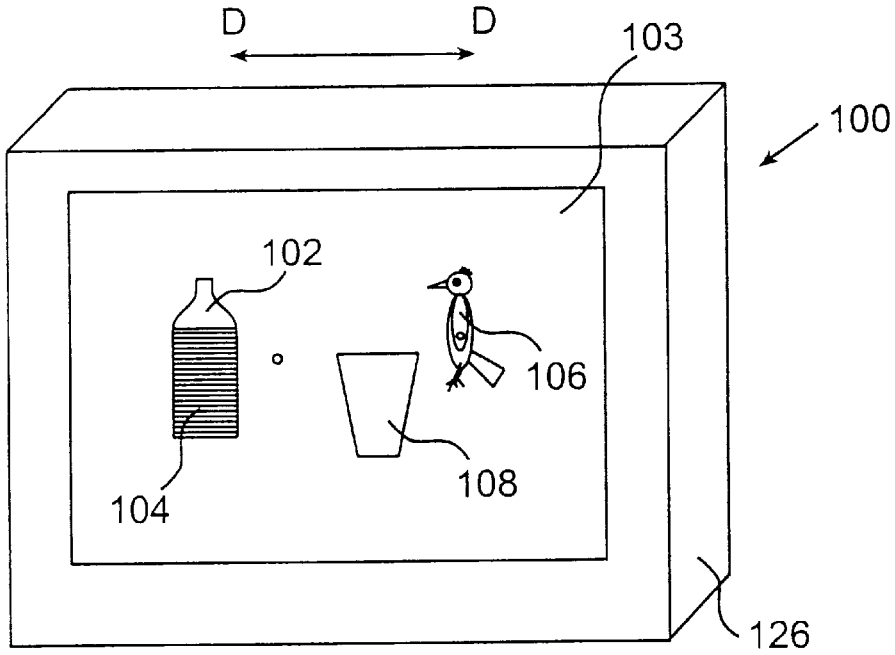
FIGS. 8A–B illustrate a first and second position of another embodiment of the present invention.
Figure 8B:
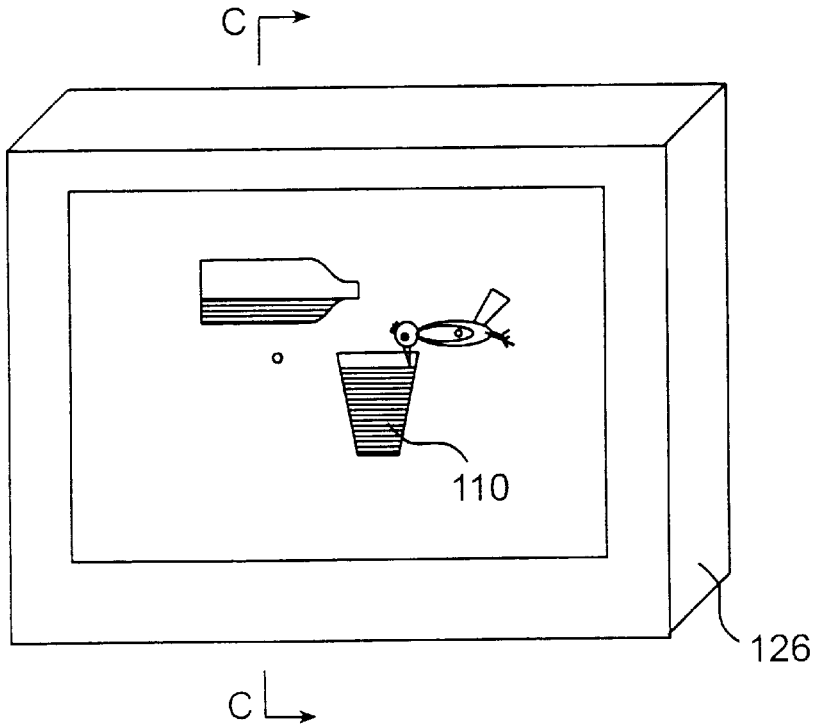

FIGS. 7E–F illustrate that driver 40 also controls movement of panel 70 via the pair of arms 65 and 66. The basic operational principle here is the same as with arms 61, 62, 63 and 64. Thus, FIG. 7E illustrates a front view of panel 70. (For clarity, arms 61, 62, 63 and 64 are not illustrated in FIGS. 7E–G so that the discussion can concentrate on the movement of arms 65 and 66) FIGS. 7E–F illustrate that when handle 41 is horizontal, arms 65 and 66 point downward thereby allowing bearing 80 to translate freely from left to right. FIG. 7G–H illustrate, however, that when handle 41 is rotated downward, arms 65 and 66 sandwich bearing 80 and impede panel 70's translational motion.

The length of the arms 61, 62, 63 and 64 and the angle of rotation of the handle 41 (i.e. $\alpha$ equals approximately 70–80°) are chosen to allow a viewer to control the opening and closing of the shutters 20 and 30 and to control the left to right movement of the panel 70. An audience member can produce a strong pulse by quickly rotating the handle 41 from $\alpha$=0° to $\alpha$=80° and back to $\alpha$=0°. This forces the shutters 20 and 30 to change from an open to a closed position (or vice versa depending on where the shutters 20 and 30 began). If, however, the pulse is not strong enough, shutters 20 and 30 will merely return back to their previous positions. Additionally, the panel 70 will be moved from left to right or right to left depending on where it started.

Another embodiment of the present invention is illustrated in FIGS. 8–12. This alternate embodiment includes a base 126 for mounting to a moving vehicle so that the direction of travel of the vehicle is parallel to line D—D. FIGS. 8A and 8B illustrate the overall visual effect of the advertising display 100 which includes a base 126 shaped as a rectangular box having a window 103 on a front side. Within the window 103 is a bottle 102 containing a liquid 104, a container 108 and a bird 106. FIG. 8A illustrates position A wherein the bottle 102 is right-side-up and filled with liquid 104. The bird 106 is also standing upright and the container 108 is empty. FIG. 8B illustrates position B wherein the bottle is tipped and the liquid 104 is shown as flowing out of the bottle 102 and into the container 108. The bird 106 is also drinking the liquid 110 from container 108.

FIGS. 9–12 illustrate the mechanics which animate advertising display 100. Basically, the advertising display comprises overlapping panels and figures which rotate in a predetermined and integrated manner so as to produce a coherent visual image.

Figure 9A:
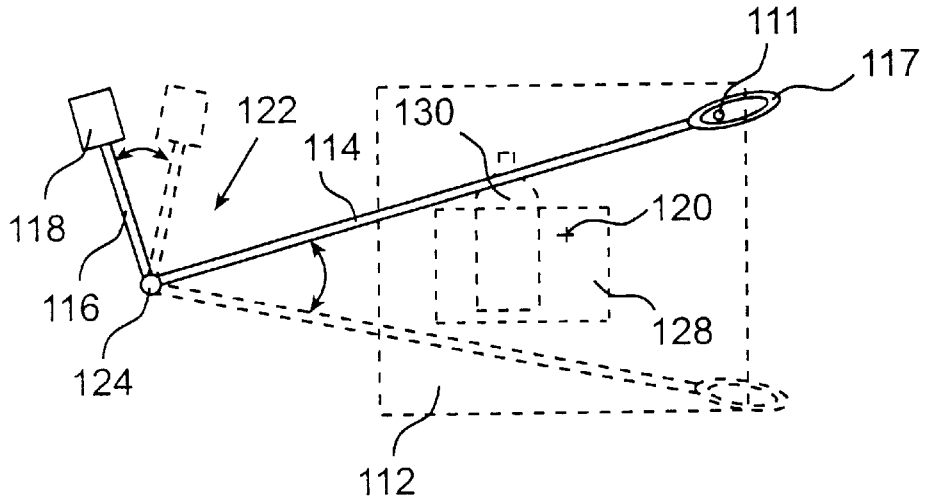
FIGS. 9A–B illustrate operation (i.e. rotation) of the panel 112 which includes moving bottle 102.
Figure 9B:
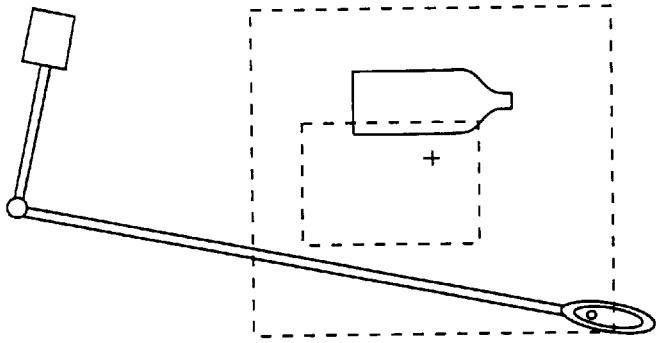

Taking each effect individually, FIGS. 9A–B illustrate how the bottle 102 moves. Panel 112 is a square non-transparent panel having a cut-out 130 which represents the bottle 102. Panel 112 can be made of any material including, but not limited to, paper, cardboard, plastic, metal, and wood. Panel 112 has a pivot point 120 about which the panel 112 can rotate 90°. Panel 120 rotates in response to movement of swing arm 122. Swing arm 122 is comprised of arms 114 and 116 coupled together at approximately 90°. The free end of arm 116 is coupled to a load 118 and the free end of arm 114 is coupled to an elliptical ring 117. A pin 111 extending from a corner of the panel 112 is looped by the ellipse 117.

The mass of the load 118 is great enough so that as the vehicle moves, the acceleration/deceleration forces acting on the load 118, cause the swing arm 122 to pivot about pivot point 124. This forces the panel 112 to rotate about its pivot point 120. FIGS. 9A and 9B illustrate the two stable positions A and B in which the panel 112 can rest. In position "A" (FIG. 9A), the bottle 102 is upright while in position "B" (FIG. 9B)the bottle 102 is on its side.

Behind the panel 112 is a fixed base 126 (shown in FIG. 13) which is mounted to the moving vehicle. Alternatively, the fixed base could be a wall of the moving vehicle. On the fixed base 126 is a square region 128 designed to look like liquid 104 in the bottle 102. Because the panel 112 is non-transparent however, the square region 128 can only be seen through the cut out 130. Furthermore, because the base 126 is fixed, the square region 128 makes the bottle 102 appear as if it is fall of liquid when upright and as if the bottle 102 is pouring the liquid 104 when on the bottle 102 is on its side.

Figure 10:
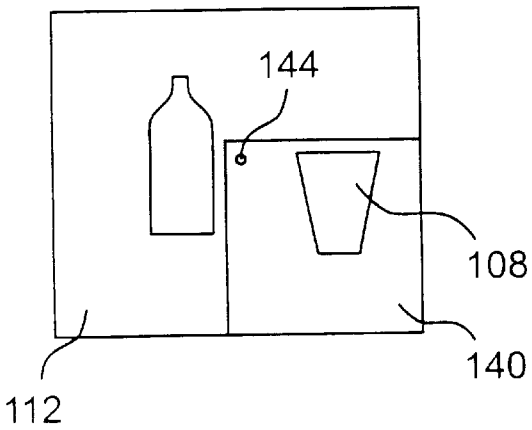
FIG. 10 illustrates operation of the screen 140 which illustrates the container 108.

FIG. 10 illustrates the container 108 as being a non-transparent screen 140 parallel to the panel 112 and fixed to the base 126 in front of the panel 112. The screen can be formed from any material including, but not limited to, the same material as the panel 112. The screen 140 also has a cut-out shaped as the container 108. The upper left point of the screen 140 is fixed to the base 126 through a dowel 144 which serves as the pivot point 120 of the panel 112. This allows the screen 140 to remain stationary as the panel 112 rotates. It should be noted that many other methods are known in the art for maintaining the screen 140 in a stationary position while simultaneously allowing panel 112 to rotate.

Figure 11A:
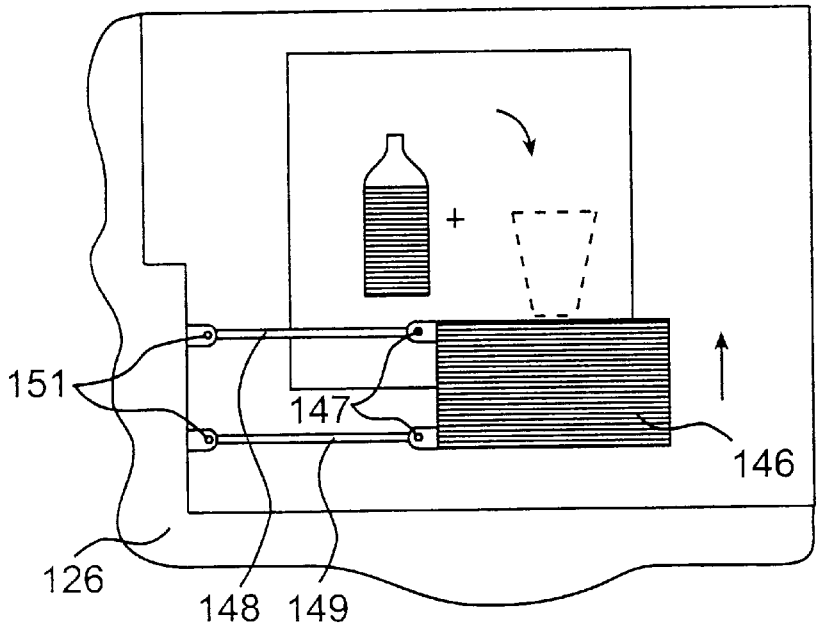
FIGS. 11A–B illustrate movement of the liquid within the container 108.
Figure 11B:
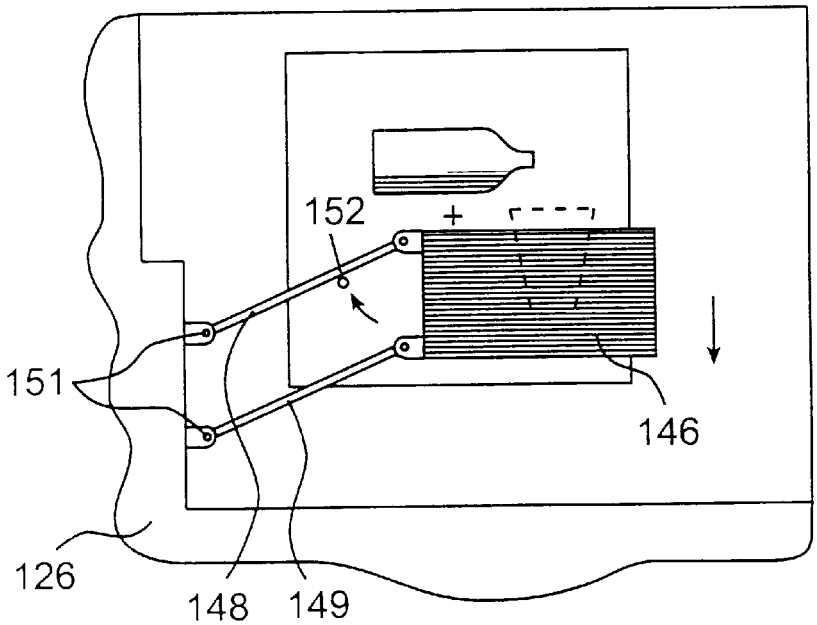

FIGS. 11A–B illustrate how the level of the liquid in the container 108 rises and lowers. Sandwiched between the panel 112 and the screen 140 is a moving rectangle 146 which is designed to resemble the liquid 104 in the bottle 102. The rectangle 146 is coupled to lever arms 148 and 149 at pivot points 147. Lever arms 148 and 149 are also coupled to the base 126 at pivot points 151. A peg 152 extends from the panel 112 and contacts the top lever arm 148 as the panel 112 rotates. The rotation of the panel 112 forces the peg 152 in a clockwise direction thereby raising the lever arms 148, 149 and the rectangle 146. Because the screen 140 is non-transparent however, a viewer is only able to see the rectangle 140 through the cutout 142. When the rectangle 146 rises, it appears as if the liquid 146 is filling container 108. In order to add to the illusion that cut outs 108 and 130 are glass, they can be covered with a transparent glass or plastic material.

Figure 12A:
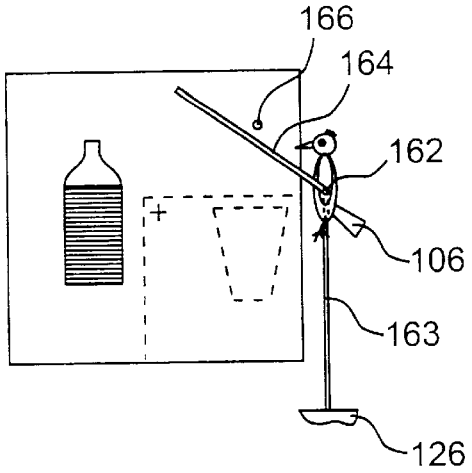
FIGS. 12A–C illustrate operation of the bird 106.
Figure 12B:
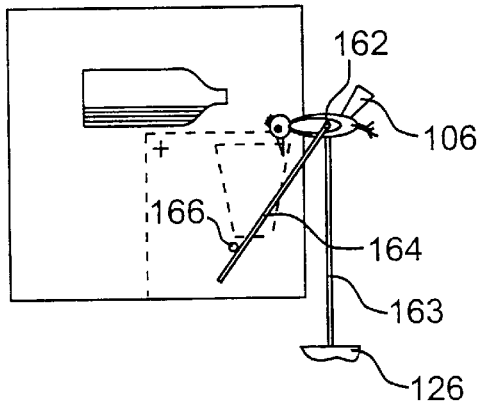
Figure 12C:
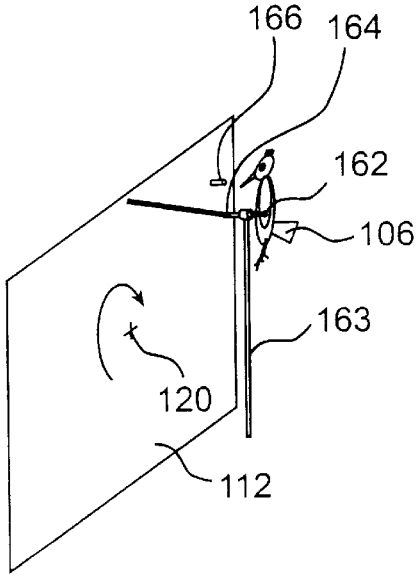

FIG. 12A–C illustrate the mechanics behind movement of the bird 106. The bird 106 has a straight rod 162 extending from the back of the bird 106 which forms a pivot point for the movement of the bird 106. The center of mass of the bird is below its pivot point so that the bird's stable position is upright. The rod 162 is pivotally coupled to a support arm 163 which is mounted to the base 126. Also extending from the straight rod 162 is an extension arm 164. A pin 166 extending from the upper right corner of the panel 112 contacts the extension arm 164 as the panel 112 rotates, thereby pushing the extension arm downward. This forces the bird 106 to rotate in a counter-clockwise direction. The pin 116 also keeps the bird bent over until the panel 112 rotates back to its original position. The visual effect is to make the bird 106 appear as if it is drinking from the container 108. When the panel 112 rotates back to its start position, the bird is able to straighten to an upright position.

Figure 13:
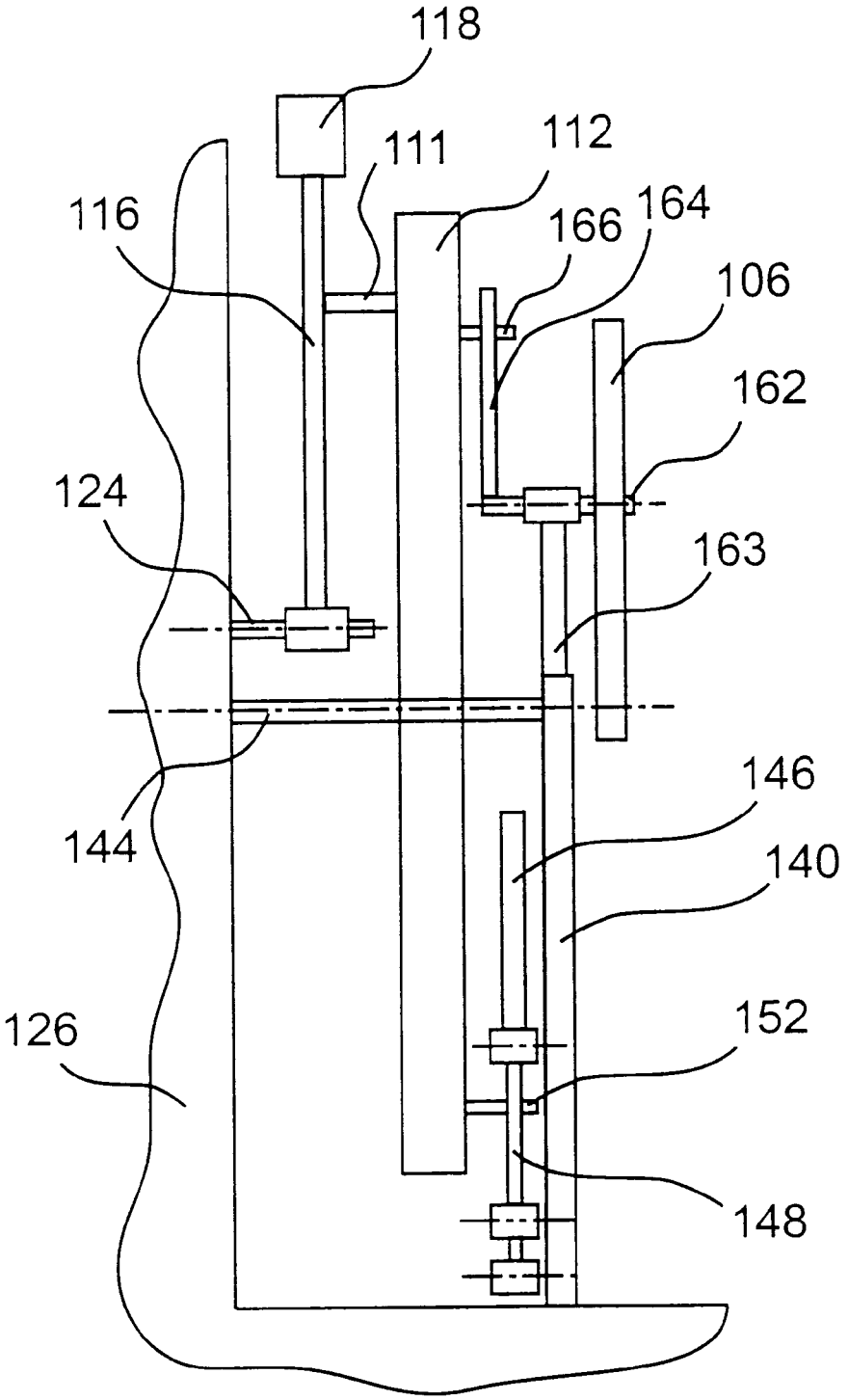
FIG. 13 illustrates a side view of the elements of the alternate embodiment along the line C—C shown in FIG. 8B.

FIG. 13 illustrates a side view of the different panels and screens of the present embodiment along line B—B shown in FIG. 8. This provides a clearer view of the layering effect and how the different elements are configured with respect to one another. From left to right, FIG. 13 illustrates arm 116 of swing arm 122, pin 111 , panel 112, pins 166 and 152, rectangle 146 and lever arms 148, screen 140, support rod 163, extension arm 164, rod 162 and bird 106.

Figure 14A:
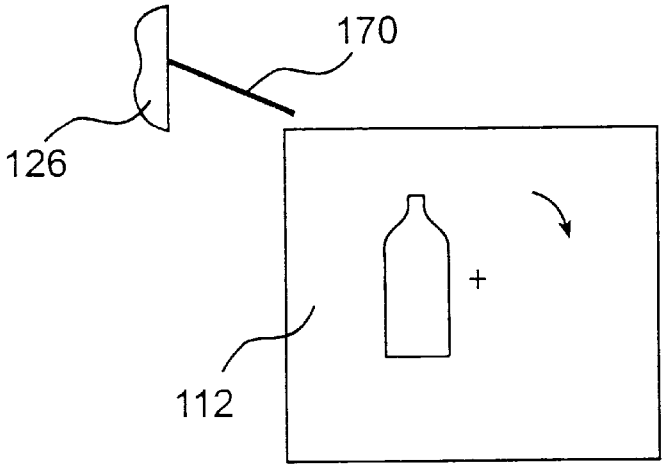
FIGS. 14*a–c* illustrate the incorporation of a sound inducing prong to the alternate embodiment.
Figure 14B:
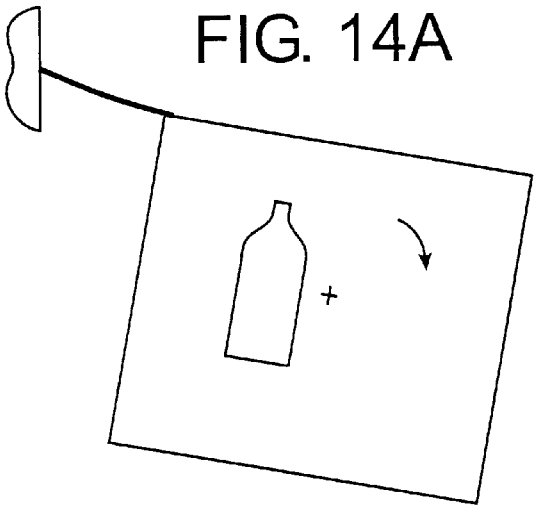
Figure 14C:
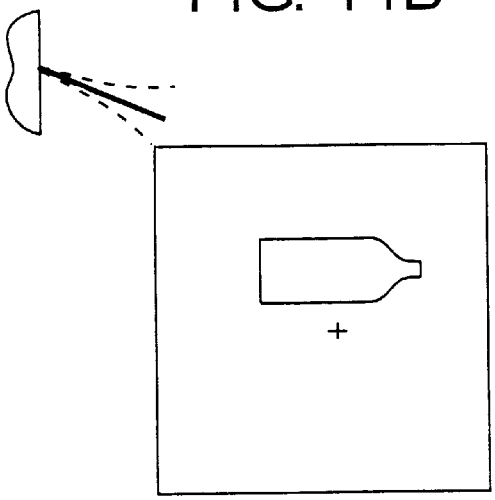

FIG. 14 illustrates that a sound inducing element can also be incorporated into the present invention. For example, a vibrating prong 170 can be mounted to the base 126 so that the prong 170 is "flicked" when the panel 112 rotates. The act of flicking the prong 170 creates a vibrational sound. It is further contemplated that other well known mechanical and/or electrical sound inducing devices be incorporated. For example, any well known electrical device for simulated different sounds can be incorporated wherein an electrical switch is incorporated so that movement of particular elements closes the switch and generates the sound. Illumination devices such as Light Emitting Diodes (LEDs) can also be integrated in a similar fashion.

We claim:

1. A motion sensitive animated advertising device for mounting to a moving vehicle that is subject to acceleration and deceleration forces in a movement plane of the advertising device, comprising:

a. a base;

b. a first element coupled to the base and to a first mass rotatable about a first pivot point for creating a biasing load for moving the first element from a first stable position to a second stable position relative to the base; and c. a second element coupled to the base and to a second mass rotatable about a second pivot point for creating a second biasing load for moving the second element from a third stable position to a fourth stable position relative to the base;

wherein the first and second elements move in conjunction with one another in response to the acceleration and deceleration of the advertising device.

2. The motion sensitive animated advertising device of claim 1 wherein the movement plane of the advertising device is parallel to a longitudinal plane of the advertising device.

3. The motion sensitive animated advertising device of claim 1 wherein the movement plane of the advertising device is transverse to a longitudinal plane of the advertising device.

4. The motion sensitive animated advertising device of claim 1 wherein the first element has a mass greater than a mass of the second element so that a greater acceleration and deceleration force is necessary to move the first element than is needed to move the second element.

5. The motion sensitive animated advertising device of claim 1 wherein the second element has a mass greater than a mass of the first element so that a greater acceleration and deceleration force is necessary to move the second element than is needed to move the first element.

6. The motion sensitive animated advertising device of claim 1 wherein the first element is a translating panel.

7. The motion sensitive advertising device of claim 6 wherein the second element is a rotatable shutter.

8. The motion sensitive animated device of claim 1 wherein the first element is a rotating panel.

9. The motion sensitive animated device of claim 8 wherein the second element is a rotating bird.

10. The motion sensitive animated advertising device of claim 1 further comprising a driver for allowing a viewer to manually control movement of the first and second elements.

11. The motion sensitive animated advertising device of claim 1 further comprising a sound inducing device for generating a sound in response to acceleration and deceleration of the advertising device.

12. The motion sensitive animated advertising device of claim 1 further comprising a light emitting device for generating a illumination in response to acceleration and deceleration of the advertising device.

13. A motion sensitive animated advertising device for mounting to a moving vehicle that is subject to acceleration and deceleration forces in a movement plane of the advertising device, comprising:

a) a base;

b) a first element coupled to the base for moving from a first stable position to a second stable position and in a first plane parallel to the movement plane; and c) a second element coupled to the base for moving from a third stable position to a fourth stable position relative to the base and in a second plane parallel to the movement plane;

wherein the first and second elements move in conjunction with one another in response to the acceleration and deceleration of the advertising device, and, wherein the first and second elements have a cause-and-effect relationship.

14. The motion sensitive animated advertising device of claim 13 wherein the cause-and-effect relationship provides for the second element to be stabilized in the fourth stable position only when the first element is in the second stable position.

15. The motion sensitive animated advertising device of claim 13 wherein movement of the second element can only be observed by a user when the first element is in the first stable position, and cannot be observed by a user when the first element is in the second stable position.

16. The motion sensitive animated advertising device of claim 1 wherein movement of the first element is in three dimensional space.

17. The motion sensitive animated advertising device of claim 1 wherein movement of the second element is in three dimensional space.

18. The motion sensitive animated advertising device of claim 13 wherein the masses and inertia of the first and second elements are such that a greater acceleration force is necessary to move the first element than is necessary to move the second element.

19. The motion sensitive animated advertising device of claim 13 wherein the masses and inertia of the first and second elements are such that a greater acceleration force is necessary to move the second element than is necessary to move the first element.

* * * * *